US007766725B2

(12) United States Patent
Umemura et al.

(10) Patent No.: US 7,766,725 B2
(45) Date of Patent: Aug. 3, 2010

(54) SHOT-BLASTING MACHINE

(75) Inventors: Mitsugi Umemura, Toyokawa (JP); Takayuki Nakada, Toyokawa (JP); Hiromasa Miura, Toyokawa (JP)

(73) Assignee: Sintokogio, Ltd., Aichi (JP)

( * ) Notice: Subject to any disclaimer, the term of this patent is extended or adjusted under 35 U.S.C. 154(b) by 478 days.

(21) Appl. No.: 11/887,736

(22) PCT Filed: Apr. 6, 2006

(86) PCT No.: PCT/JP2006/307337

§ 371 (c)(1),
(2), (4) Date: Oct. 3, 2007

(87) PCT Pub. No.: WO2006/109674

PCT Pub. Date: Oct. 19, 2006

(65) Prior Publication Data

US 2009/0047878 A1 Feb. 19, 2009

(30) Foreign Application Priority Data

Apr. 6, 2005 (JP) ..... 2005-109914
Oct. 20, 2005 (JP) ..... 2005-305258

(51) Int. Cl.
*B24C 7/00* (2006.01)

(52) U.S. Cl. ..... 451/99; 451/85; 451/86

(58) Field of Classification Search ..... 451/85, 451/86, 99

See application file for complete search history.

(56) References Cited

U.S. PATENT DOCUMENTS 2,116,160 A * 5/1938 Rosenberger et al. ..... 451/2
2,131,771 A * 10/1938 Turnbull ..... 414/648
3,800,478 A * 4/1974 Rampe et al. ..... 451/326
4,047,334 A * 9/1977 Kuehn ..... 451/85
4,432,168 A * 2/1984 Rampe ..... 451/326
6,283,839 B1 * 9/2001 Frederick et al. ..... 451/86

FOREIGN PATENT DOCUMENTS

| | | |
|---|---|---|
| JP | 57-102756 | 6/1982 |
| JP | 60-9659 | 1/1985 |
| JP | 106174/1990 | 5/1992 |
| JP | 06-126633 | 5/1994 |
| JP | 07-266232 | 10/1995 |

* cited by examiner

*Primary Examiner*—Maurina Rachuba
(74) *Attorney, Agent, or Firm*—Finnegan, Henderson, Farabow, Garrett & Dunner, L.L.P.

(57) ABSTRACT

A loader arrangement 7 of a shot-blasting machine includes a bucket loader 29 having a tip opening that can be opened and closed by means of a lid 35. The loader arrangement 7 also includes a swivel arm 32, which is vertically and pivotally attached to a frame 4 via a linkage 31, for vertically swiveling the bucket loader 29, and a chain block 34 for swiveling the arm 32. Once the bucket loader 29 has reached the upper position above a rotary drum 5 by means of the swivel arm 32, a guide means 30, which is attached to the arm 32, allows the bucket loader 29 to approach the drum 5 through its top opening by driving a hydraulic cylinder 33, while the tip of the bucket loader 29 is opposed to the bottom wall of the drum 5. Once the tip of the bucket loader 29 is close to the bottom wall or the inner peripheral wall of the drum 5, the lid 35 is opened to drop the work pieces in the bucket loader 29 into the drum 5. Because the work pieces thus tumble from the low level relative to the bottom wall or the inner peripheral wall of the drum 5, the impact of the work pieces being dropped can be inhibited, and thus damage to the work pieces and the noise of the sounds of hitting can be reduced.

10 Claims, 3 Drawing Sheets

SHOT-BLASTING MACHINE

TECHNICAL FIELD OF THE INVENTION

This invention relates to a shot-blasting machine for blast-cleaning work pieces. More specifically, this invention relates to the shot-blasting machine with a bucket loader for loading the work pieces into an inclinable rotary drum.

BACKGROUND OF THE INVENTION

Japanese Patent Early-Publication 57-102756, assigned to the applicant of the present application, discloses a shot-blasting machine that includes an inclinable rotary drum for stirring work pieces to be cleaned, and a bucket loader for loading the work pieces into the rotary drum. In this prior-art machine, the bucket loader is lifted above and is then inclined toward a top opening of the rotary drum such that the work pieces within the bucket loader tumble into the rotary drum by their own weight.

In the prior-art shot-blasting machine, however, the bucket loader positioned above the top opening of the rotary drum must be significantly inclined to enable the work pieces therein to tumble by their own weight. At this time, the bucket loader should also be located at a level that is a great distance apart from the inner peripheral wall or the bottom wall (on which the tumbled work pieces land or collide with the bucket loader). Accordingly, the tumbled work pieces fall down at a relatively high rate and thus crash onto the inner peripheral wall or the bottom wall of the bucket loader, or crush other work pieces or work pieces located on the bottom wall. Therefore, problems wherein the work pieces show signs of brushing or damage and thus induce noisy hitting sounds have arisen.

DISCLOSURES OF THE INVENTION

Accordingly, one object of this invention is to provide a shot-blasting machine that inhibits the impacts of work pieces or crushed work pieces so as to prevent their being damaged and thus to deaden noises from them.

The shot-blasting machine for cleaning the work pieces of the present invention comprises a frame; a cylindrical drum inclinably mounted on the frame such that the drum is rotated about the longitudinal axis thereof, the drum having a top opening, an opposite bottom-wall, and an inner peripheral-wall so as to define a chamber in which the work pieces are processed therebetween; a flapper for opening and closing the top opening of the drum; a device mounted on the inner surface of the flapper for impelling abrasive particles into the chamber; a bucket loader having an opening end and a closing leading end and which together define a loading chamber in which the work pieces are loaded; means for adjusting the degree to which the leading end of the bucket loader is opened; a transferring mechanism for reciprocatingly transferring the bucket loader in a path that includes a lower position in which the work pieces are loaded into the loading chamber of the bucket loader through the opened leading end, an intermittent step in which the bucket loader is upwardly moved while the leading end is closed, and an upper position in which the closed leading end of the bucket loader is opposite the opened top opening of the drum; a guiding mechanism for guiding the bucket loader, which reaches the upper position such that the bucket loader is inserted in and withdrawn from the processing chamber of the drum through the top opening thereof with the leading end of the bucket loader being opposite the bottom wall of the drum; and wherein the adjusting means opens the leading end of the inserted bucket loader in the processing chamber of the drum after the leading end accesses the bottom wall or the inner peripheral-wall of the processing chamber, whereby the loaded work pieces in the bucket loader fall into the processing chamber of the drum.

In one embodiment of the present invention, the guiding mechanism includes a hydraulic cylinder, while the adjusting means includes a lid for closing and opening the leading end of the bucket loader by means of another hydraulic cylinder. Alternatively, each hydraulic cylinder may be replaced with an electrical cylinder with a servomotor.

The shot-blasting machine of the present invention may further include a cabinet that has a superior edge defining a top entrance, inclinably mounted on the frame. In this case, the rotary drum is rotatably mounted within the cabinet such that the drum and the cabinet incline in unison with the top opening of the drum and such that the top entrances of the cabinet are aligned.

If the rotary drum is installed within the cabinet, the forgoing single flapper in its closed position can close the top opening of the drum and the top entrances of the cabinet. In this case, in order to prevent the flying of and splattering of the abrasive particles from the cabinet, the shot-blasting machine preferably further includes a labyrinthine structure for closing any gap between the superior edge of the cabinet and the inner edge of the flapper and any gap between the top opening of the drum and the inner surface of the flapper when the flapper in the closed position, and an elastic sealing compound fitted along the inner edge of the flapper to close any gap between the labyrinthine structure and the inner edge of the flapper.

In another embodiment of the present invention, the labyrinthine structure includes a compressing member extending from the inner surface of the superior edge of the cabinet to the elastic sealing member for compressing said elastic sealing compound to close a gap between the superior edge of the cabinet and the elastic sealing member when the flapper is in the closed position; a flange member extending from the inner surface of the compressing member to near the outer peripheral-wall of the drum; a planner member mounted on the inner surface of the flapper for closing a gap between the inner surface of the flapper and the top opening of the drum around the impelling device, wherein the outer edge portion of the planner member is opposed to the flange member; and a cylindrical member extending from the inner surface of the planner member near the outer edge thereof to the upper surface of the flange member.

In another embodiment of the invention, the distance between the leading edge of the cylindrical member and the upper surface of the flange member is three to five times the maximum diameter of the abrasive particles.

Preferably, the proximal portion of the flange member is provided with a plurality of apertures such that abrasive particles migrate into the clearance between the proximal portion of the flange member and the elastic sealing compound being returned into the cabinet.

In another embodiment of the invention, the compressing member compresses the elastic sealing compound to 5 to 80% of the initial size of it when the flapper is in the closed position.

Further objects, features, and advantages of the present invention will be apparent by reference to the following detailed description when taken in conjunction with the accompanying drawings.

PREFERRED EMBODIMENTS

FIG. 1 shows a shot-blasting machine of the first embodiment of the present invention. This machine is a batch treatment version in which a plurality of work pieces (e.g., parts) to be cleaned and shot particles (abrasive particles) are fed in a cylindrical rotary drum 5 such that the work pieces are stirred and cleaned by rotating the drum 5. The shot blasting machine includes a frame 4, the drum 5 being pivotally supported on the frame 4 by means of tilting equipment (not shown) to enable it to be tilted, and a rotating mechanism 5*a* mounted on the tilting equipment for rotating the drum 5 about its longitudinal axis. The drum 5 is cylindrically shaped with a top opening. The opposite bottom wall and an inner peripheral wall define the treatment chamber in which the work pieces are processed therein. The initial position of the drum 5 is configured such that its top opening faces obliquely upward. The shot-blasting machine also includes a flapper 8 for opening and closing the top opening of the drum 5, a shot impeller 21 mounted on the inner surface of the flapper 8, a swiveling mechanism 6 for swiveling the flapper 8, a loader arrangement 7 for dropping the work pieces into the treatment chamber of the drum 5 through its top opening, and a recirculation system 28 for collecting the shots ejected from the drum 5 and for bringing them back into the shot impeller 21.

The loader arrangement 7 includes a bucket loader 29, which has a tip opening and which forms a loading chamber therein. The tip opening of the bucket loader 29 can be opened and closed by means of a lid 35.

The loader arrangement 7 also includes a transferring arrangement for vertically swiveling the bucket loader 29. This transferring arrangement is to transfer the bucket loader 29 along a path that includes a lower position in which the work pieces are being loaded into the loading chamber of the bucket loader 29, an intermediate path in which the bucket loader 29 is being upwardly moved while its tip opening is closed, and an upper position in which the bucket loader with the closed tip opening is being opposed to the opened top opening of the tilted drum 5. For this purpose, the transferring arrangement includes a swivel arm (transferring means) 32, which is vertically and pivotally attached to the frame 4 via a linkage 31 and which supports the bucket loader 29 by a guide means 30, described below, and a chain block 34 for swiveling the arm 32.

After the bucket loader 29 has reached the upper position, the guide means 30 allows the bucket loader 29 to approach and withdraw from the treatment chamber of the drum 5 through its top opening. To this end, the bucket loader 29 is supported by the guide means 30 such that the bucket loader 29 reciprocally and slidably moves along the upper surface of the swivel arm 32 by driving a hydraulic cylinder 33, which is attached to the bucket loader.

Once the bucket loader 29 has reached the upper position, on which the lid 35 of the bucket loader 29 has not yet closed, by means of a transferring mechanism the bucket loader 29 with the closed lid 35 approaches the treatment chamber of the drum 5 by the guide means 30. After the tip of the bucket loader 29 is close to the bottom wall or the inner peripheral wall, the lid 35 is opened to drop the work pieces from the loading chamber of the bucket loader 29 to the treatment chamber of the drum 5. To this end, the loading arrangement 7 also includes a cylinder 37 having a linkage 36, which is attached to the bucket loader 29 to open and close the lid 35. The linkage 36 is provided with two sensors (adjusting means) 38, 39 for detecting the open position and the closed position of the lid 35, respectively. A target position to be detected by the sensor 38 for detecting the open position can be manually adjusted using an appropriate conventional technique. Accordingly, the degree of the opening area of the tip of the bucket loader 29 can be adjusted to control the amount of the work pieces that are dropped from the bucket loader, and can thus be prevented from colliding with each other.

Hydraulic circuitry (not shown) for driving the hydraulic cylinder 33 of the guide means 30 may preferably be provided with a flow control valve to control the traveling speed of the bucket loader 29 when it is withdrawn or retracted from the drum 5. Further, a controller for controlling a directional control valve (neither shown) in the hydraulic circuitry may preferably be provided with a control timer. An appropriate setting of the control timer may determine the timing to initiate the retraction of the bucket loader 29 from the drum 5 based on the amount of the work pieces dropped from the bucket loader 29 into the drum 5.

To explain the operation of the shot-blasting machine, assume that the bucket loader 29 is now in the lower position (as shown by a solid line 29 in FIG. 1) with the predetermined amount of the work pieces (not shown) to be cleaned having been loaded into their loading chamber, whose tip opening has been closed by the lid 35. Also assume that the drum 5 is now tilted to the side of the bucket loader 29 with the top opening being open. From this state, the bucket loader 29 is being moved through the upper position, where the closed tip end of it is opposed to the top opening of the drum 5 and is advanced (as shown by a dotted line in FIG. 1) into the drum 5 to open the tip end to load the work pieces therein. To carry out such a step the chain block 34 is operated to drive the swivel arm 32 to lift up the bucket loader 29 to near the top opening of the drum 5 and to tilt the bucket loader 29 to a degree which allows the work pieces in the loading chamber to tumble down therein while the closed tip end is opposed to the top opening of the drum 5. The hydraulic cylinder 33 is then operated to bring the bucket loader 29 into the treatment chamber of the drum 5 through the top opening of the drum 5 such that the tip end of the bucket loader 29 is close to the inner peripheral wall or the bottom wall of the drum 5, while the closed tip end of the bucket loader 29 is opposed to the bottom wall of the drum 5. The cylinder 37 with the linkage 36 is then operated to rotate the lid 35 counterclockwise to open the tip end of the bucket loader 29 to the desirable range of its open area, based on the detection of the corresponding end of the opening by the sensor 38, to load the work pieces into the treatment chamber of the drum 5 from the bucket loader 29. In this case, because the work pieces in the bucket loader 29 tumble down there from when the tip end is first opened, the work pieces are dropped from a lower level to the drum 5. Accordingly, the impacts of the dropped work pieces can be reduced compared with the conventional shot-blasting machine, in which the work pieces in the prior-art bucket loader should be dropped from a relatively higher level. Thus, the damage to the work pieces that is caused because of their crashing into the inner surfaces of the drum 5 or with each other is reduced. The noisy hitting sounds caused by the collisions of the work pieces may also be reduced.

After the work pieces tumble from the loading chamber of the bucket loader to the treatment chamber of the drum, the hydraulic cylinder 33 is inversely operated to withdraw the bucket loader 29 from the treatment chamber of the drum. The flapper 8 of the top opening of the drum is then closed. The shot impeller 21 then impels the shot particles into the treatment chamber of the drum 5, while the drum 5 is rotated to stir the work pieces. The bucket loader 29 is returned to the lower position by inversely operating the swivel arm 32 to wait for the following load of the work pieces.

Although in the above embodiment the means for reciprocatingly moving the bucket loader 29 is the hydraulic cylinder 33, it may be altered to be an electrical cylinder with a servomotor.

In the above embodiment, the linkage 36 is provided with the sensors 38 and 39 to detect the opened and closed positions of the lid 35 to control the operations of the hydraulic cylinder 37 to open and close the lid 35 such that the lid 35 can be suspended at the predetermined opening positions, which positions have not yet reached the full opening position of the lid 35. Or, an electrical cylinder with a servomotor may be used such that the lid 35 can be suspended at the predetermined opening positions.

The rotary drum 5 may be titled by accommodating it in a tilting cabinet. FIG. 2 shows an example of tilting equipment, but the invention is not limited to it. It employs such a tilting cabinet for use with the shot-blasting machine of the present invention. The tilting equipment as shown in FIG. 2 includes a top opening cabinet 1, which is inclinable and pivotally supported by the frame 4 via a pair of supporting shafts 2 and a pair of corresponding bearings 3. The rotary drum 5 is rotatably mounted on the cabinet. The cabinet 1 is configured such that its top opening faces obliquely upward when it is in its initial position. The rotary drum 5 is arranged such that its top opening is opposed to the top opening of the cabinet 1. The rotary drum 5 is rotatably supported by, instead of the rotating mechanism as shown in FIG. 1, two pairs of receiving roller assemblies 36 and a supporting shaft assembly 37 mounted on the cabinet 1 such that the rotary drum 5 is rotated on the surface that is orthogonal to the top openings of the drum 5 and the cabinet. The peripheral surface of the drum 5 is provided with a plurality of apertures for ejecting shot particles. In this tilting equipment, the flapper 8 is mounted on the cabinet 1 to close the top opening of the cabinet 1, as well as the top opening of the drum 5. As above described with respect to FIG. 1, the shot impeller 21 is mounted on the inner surface of the flapper 8. The flapper 8 is in the open position, as denoted by the dotted line in FIG. 2, when the work pieces are loaded into the drum 5 through the top opening of the cabinet and the top opening of the drum. Further, the flapper 8 is in the closed position when the shot impeller 21 propels the shot particles into the drum 5 through its top opening (hereinafter, the term "the closed position" means the position in which the flapper 8 closes both the top opening of the cabinet and the top opening of the drum). To open and close the flapper in such a manner, instead of the swiveling mechanism 6, the proximal ends of a pair of first arms 10 and the proximal ends of a pair of second arms 18 are pivotally attached to the upper portion and the lower portion of the flapper 8 via a first pivotal pin 9 and second pivotal pin 17, respectively. Each distal end of the pair of first arms 10 is fixed to a supporting shaft 11, which is attached to the upper portion of the cabinet 1, while each distal end of the pair of second arms 18 is fixed to the corresponding supporting shaft 2. One end portion of the supporting shaft 11 is coupled to an output shaft of a motor 14 with reduction gears via chain wheels 13, 15 and a roller chain 16. Forward and inverse rotations of the motor 14 with the reduction gear normally and inversely rotate the supporting shaft 11 to swivel the flapper 8, as shown by the dotted line in FIG. 2, to open and close the top opening of the cabinet 1 and the top opening of the drum 5.

Using this tilting equipment, the angle of the gradient of the drum 5 can be adjusted. Some clearance between the top end of the drum 5 and the flapper 8 should be provided to prevent the flapper 8 from interfering with the rotating motion of the drum 5. This may cause the shot particles that are projected from the shot impeller 21 to fly out from the area of the clearance to the periphery. To provide a shatter-resistant structure for the shot particles, a labyrinthine structure 22 and a sealing member 23 may preferably be provided as shown in FIGS. 3 and 4.

In FIGS. 3 and 4, the labyrinthine structure 22 is provided between the top opening of the cabinet 1 and flapper 8 to close the clearance therebetween when the flapper 8 is in the closed position. The inner edge of the flapper 8 is provided with an elastic circular sealing compound 23 to seal the clearance between the flapper 8 and the labyrinthine structure 22 when the flapper 8 is in the closed position.

The labyrinthine structure 22 includes a cylindrical compressing member (a first member) 24 extending from the inner surface of the superior edge of the cabinet to the elastic sealing compound 23 for compressing the elastic sealing compound to close the gap between the superior edge of the cabinet and the elastic sealing compound when the flapper 8 is in the closed position. The labyrinthine structure 22 also includes a flange member (a second member) 25 extending from the inner surface of the compressing member 24 to close the outer peripheral wall of the drum 5. The labyrinthine structure 22 also includes a planner member (a third member) **26*a* mounted on the inner surface of the flapper 8 for closing the gap between the inner surface of the flapper 8 and the top opening of the drum 5 around the shot impeller 21. The outer edge portion of the planner member 26*a* is opposed to the flange member 25. The labyrinthine structure 22 also includes a cylindrical member (a fourth member) 26*b* extending from the inner surface of the planner member 26*a* that is near the outer edge thereof to the upper surface of the flange member 25. The planner member 26*a* and the cylindrical member 26*b* are formed together as an integral cap. The first compressing member 24 is long enough to enable it to compress the elastic sealing compound 23 to its predetermined size, as, e.g., 5 to 80% of the initial size of it, when the flapper 8 is in the closed position. The outer diameter of the third planner member 26*a* is greater than the inner diameter, which is the diameter of an opening defined by the second flange member 25 such that the outer edge of the third planner member 26*a* is opposed to the flange member 25. The distance of the gap between the upper surface of the second flange member 25 and the leading edge of the fourth cylindrical member 26*b*** is three to five times the maximum diameter of the shot particles.

To avoid the labyrinthine structure 22 interfering with the rotating motion of the drum 5 when the flapper is in the closed position, the outer surface of the cabinet 1 near its top opening is preferably provided with a stopper 20 on which the cap (i.e., the planner member **26*a* and the cylindrical member 26*b*) abuts. The stopper 20 allows the drum 5 to rotate, since some gap between the labyrinthine structure 22 and the distal end of the drum 5** is formed.

As shown in FIG. 4, the proximal portion of the second flange member 25 is provided with a plurality of small apertures 27 such that shot particles that pass through a gap between the proximal portion of the second flange member 25 and the fourth cylindrical member **26*b* return into the cabinet 1**.

In the illustrated arrangement, once the work pieces to be shot-blasted are loaded into the drum 5, the flapper 8 is moved to the closed position by driving the motor 14 forwardly such that the shot particles are projected from the shot impeller 21 into the drum 5 that is rotated. In this situation, the labyrinthine structure 22 and the sealing compound 23 prevent the flying shot particles that have jumped out from the distal end of the drum 5 from scattering into the periphery.

A piece of prior-art tilting equipment in which the rotary drum 5 to be tilted is accommodated in a tilting cabinet is disclosed in Japanese Utility Model Publication No. 3-25900, assigned to the applicant of the present application. Because this conventional tilting equipment includes neither the labyrinthine structure 22 nor the sealing compound 23, it cannot prevent the shot particles from flying out through the gap between the distal end of the drum 5 and the flapper 8.

While the present invention is disclosed as a shot-blasting machine, it should be understood that the abrasive particles used in the machine can be of varying grades, from small grit to a relatively large shot. Because the forgoing embodiments are not to limit the present invention, those skilled in the art can appreciate the fact that numerous modifications or variations may be made therein without departing from the scope of the accompanying claims.

Figure 1:
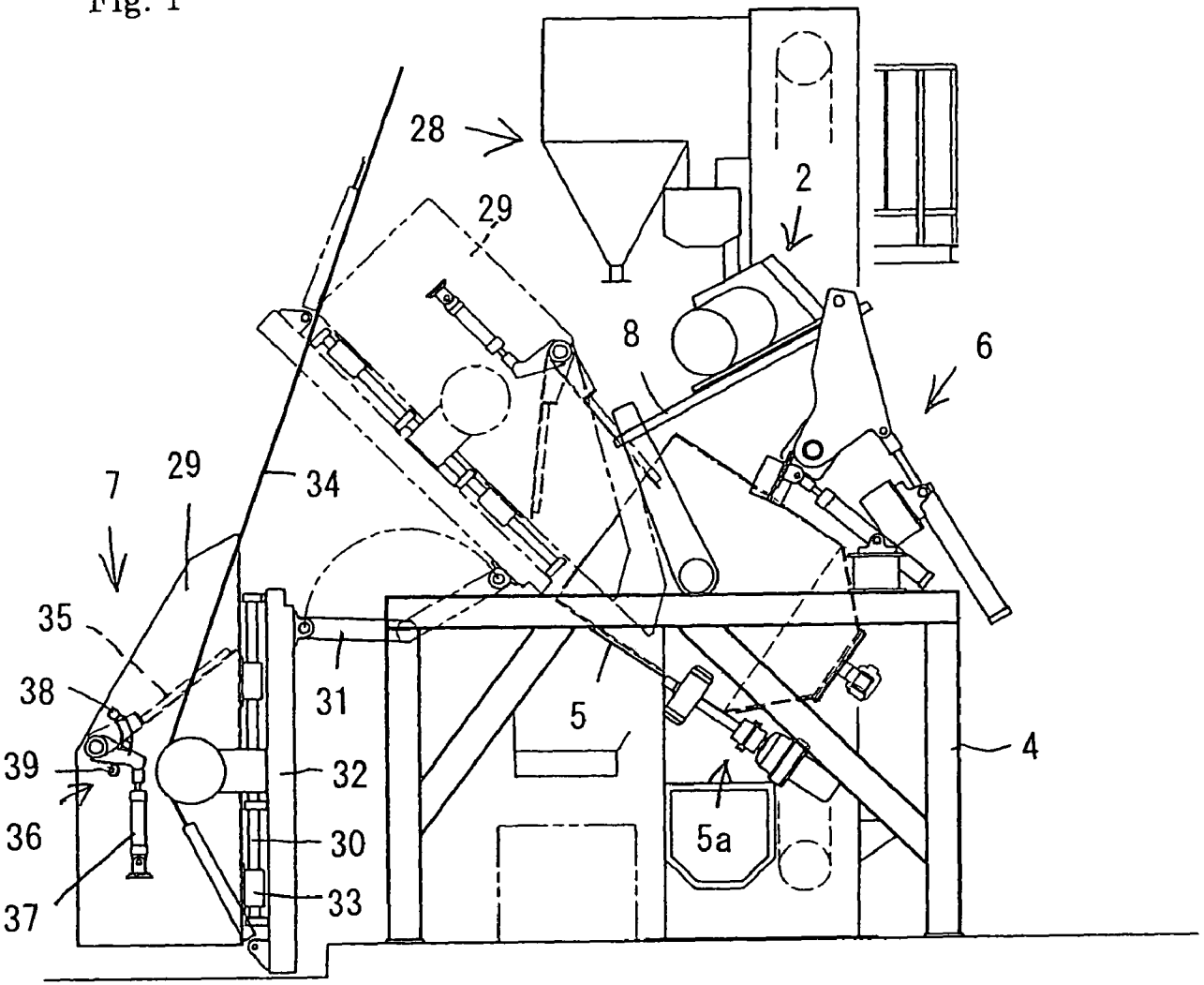
FIG. 1 is a side view of the shot-blasting machine of the present invention.
Figure 2:
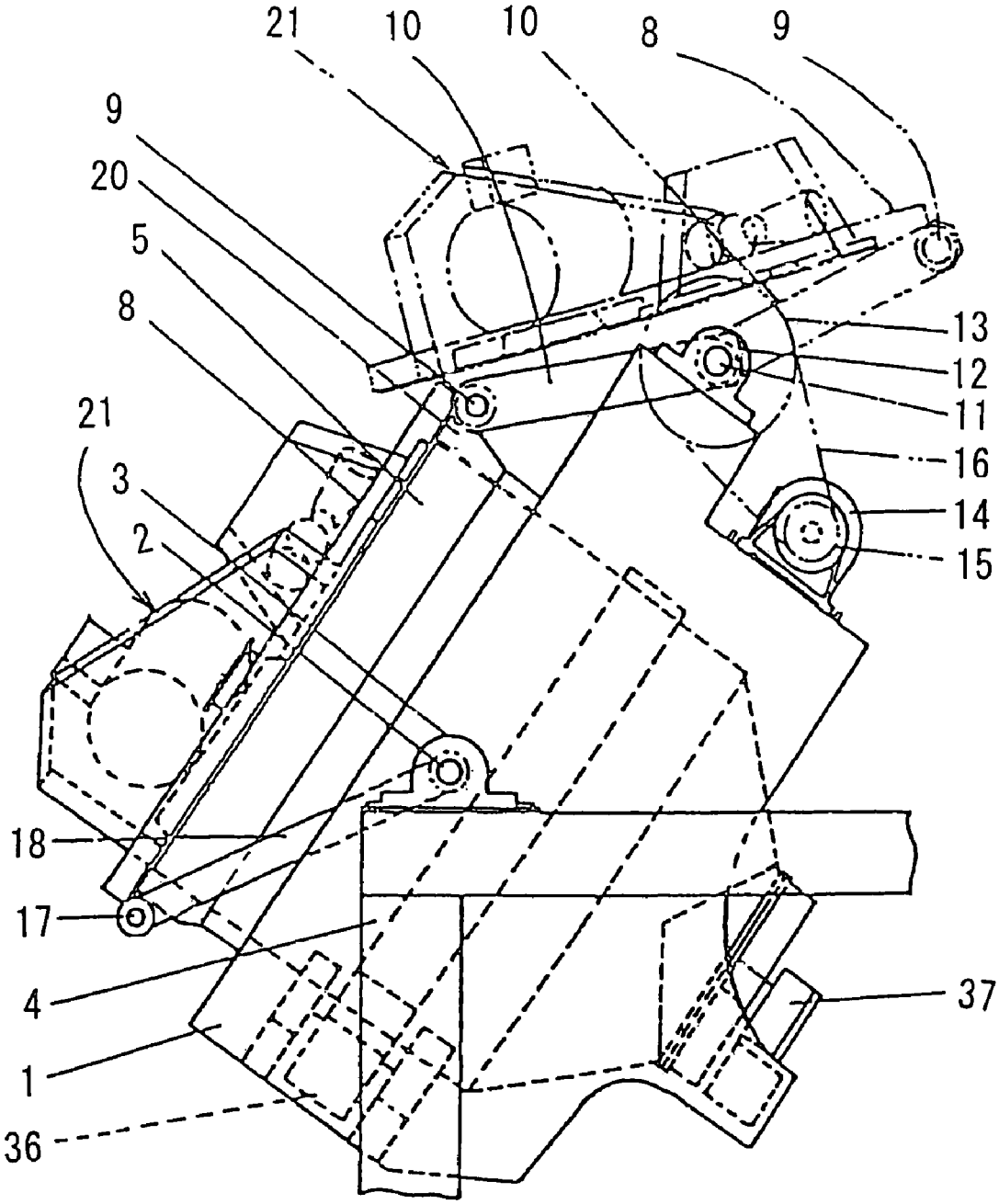
FIG. 2 is a side view of an example of tilting equipment that may be used with the shot-blasting machine of the present invention.
Figure 3:
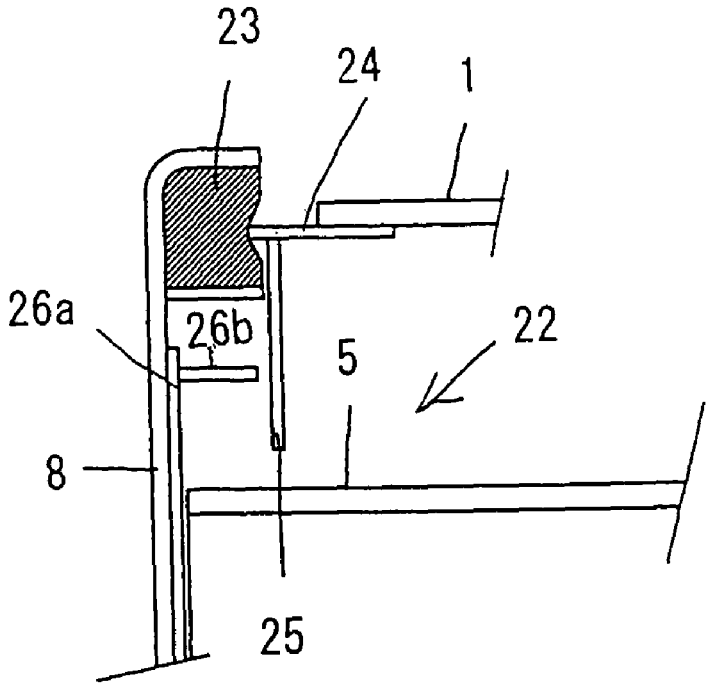
FIG. 3 is a schematically cross-sectional view of a labyrinthine structure that may be incorporated with the tilting equipment of FIG. 2.
Figure 4:
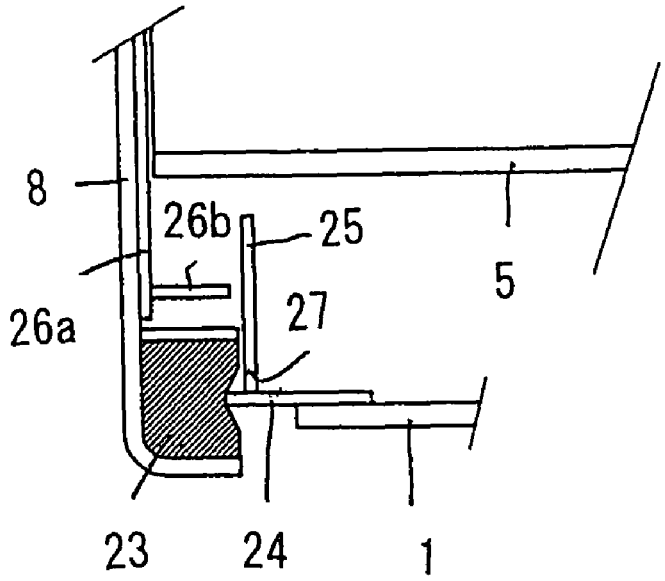
FIG. 4 is a schematically cross-sectional view of a labyrinthine structure that may by incorporated with the tilting equipment of FIG. 2.

The invention claimed is:

1. A shot-blasting machine for cleaning work pieces, comprising:

a frame;

a cylindrical drum inclinably mounted on said frame such that said drum is rotated about the longitudinal axis thereof, said drum having a top opening, an opposite bottom wall, and an inner peripheral wall so as to define a chamber in which the work pieces are processed therebetween;

a flapper for opening and closing said top opening of said drum;

a device mounted on the inner surface of said flapper for impelling abrasive particles into said chamber;

a bucket loader having an opening leading-end and closing leading-end and defining a loading chamber in which the work pieces are loaded;

adjusting means for adjusting the degree of the opening of said leading end of said bucket loader;

transferring means for reciprocatingly transferring said bucket loader in a path that includes a lower position in which the work pieces are loaded into said loading chamber of said bucket loader through said opened leading end, an intermittent step in which said bucket loader is upwardly moved when the leading end is closed, and an upper position in which said closed leading end of said bucket loader is opposed to said opened top opening of said drum;

guide means for guiding said bucket loader when it reaches said upper position such that said bucket loader advances to and withdraws from said processing chamber of said drum through said top opening thereof with said leading end of said bucket loader being opposed to said bottom wall of said drum; and wherein said adjusting means opens said leading end of said inserted bucket loader in said processing chamber of said drum after said leading end accesses said bottom wall or said inner peripheral wall of said processing chamber, whereby said loaded work pieces in said bucket loader fall into said processing chamber of said drum.

2. The shot-blasting machine of claim 1, wherein said guiding mechanism includes a hydraulic cylinder or an electrical cylinder with a servomotor.

3. The shot-blasting machine of claim 1, wherein said adjusting means includes a lid for closing and opening said leading end of said bucket loader by means of a hydraulic cylinder or an electrical cylinder with a servomotor.

4. The shot-blasting machine of claim 1, further including a cabinet inclinably mounted on said frame, said cabinet having a superior edge defining a top entrance, and wherein said rotatable drum is rotatably mounted within said cabinet such that said drum and said cabinet are inclined in unison with said top opening of said drum and such that said top entrances of said cabinet are aligned.

5. The shot-blasting machine of claim 4, wherein said flapper has an inner edge, and wherein said flapper closes both said top opening of said drum and said top entrances of said cabinet and in the closed position of said flapper.

6. The shot-blasting machine of claim 5, further including a labyrinthine structure for closing a gap between said superior edge of said cabinet and said inner edge of said flapper and a gap between said top opening of said drum and said inner surface of said flapper when said flapper is in the closed position, and an elastic sealing compound fitted along said inner edge of said flapper to close a gap between said labyrinthine structure and said inner edge of said flapper.

7. The shot-blasting machine of claim 6, wherein said labyrinthine structure includes:

a compressing member extending from the inner surface of said superior edge of said cabinet to said elastic sealing member for compressing said elastic sealing compound to close a gap between said superior edge of said cabinet and said elastic sealing member when said flapper is in the closed position;

a flange member extending from the inner surface of said compressing member to a position close to the outer peripheral wall of said drum;

a planner member mounted on the inner surface of said flapper for closing a gap between the inner surface of said flapper and said top opening of said drum around said impelling device, wherein the outer edge portion of said planner member is opposed to said flange member; and a cylindrical member extending from the inner surface of said planner member near the outer edge thereof to the upper surface of said flange member.

8. The shot-blasting machine of claim 7, wherein the distance of the gap between the leading edge of said cylindrical member and the upper surface of said flange member is three to five times the maximum diameter of said abrasive particles.

9. The shot-blasting machine of claim 8, wherein the proximal portion of said flange member is provided with a plurality of apertures such that said abrasive particles that have migrated into the clearance between the proximal portion of said flange member and said elastic sealing compound are returned into said cabinet.

10. The shot-blasting machine of claim 7, wherein said compressing member compresses said elastic sealing compound to 5 to 80% of the initial size of it when said flapper is in the closed position.

* * * * *